US006516949B2

(12) United States Patent
Fuller et al.

(10) Patent No.: US 6,516,949 B2
(45) Date of Patent: Feb. 11, 2003

(54) BLISTER PILL PACKAGE WITH SAFETY BACKING

(75) Inventors: Kenneth E. Fuller, Chalfont, PA (US); Harry S. Sowden, Glenside, PA (US)

(73) Assignee: McNeil-PPC, Inc., Skillman, NJ (US)

( * ) Notice: Subject to any disclaimer, the term of this patent is extended or adjusted under 35 U.S.C. 154(b) by 0 days.

(21) Appl. No.: 09/873,536

(22) Filed: Jun. 4, 2001

(65) Prior Publication Data

US 2002/0008046 A1 Jan. 24, 2002

Related U.S. Application Data

(63) Continuation-in-part of application No. 09/146,567, filed on Sep. 3, 1998, now abandoned, which is a continuation-in-part of application No. 08/807,003, filed on Feb. 26, 1997, now abandoned, which is a continuation of application No. 08/550,901, filed on Oct. 31, 1995, now abandoned, and a continuation of application No. 08/770,022, filed on Dec. 19, 1996, now Pat. No. 5,740,717.

(51) Int. Cl.[7] ..... B65D 83/04
(52) U.S. Cl. ..... 206/530; 206/539
(58) Field of Search ..... 206/528, 530, 206/532, 534, 534.1, 534.2, 538, 539, 459.5

(56) References Cited

U.S. PATENT DOCUMENTS

| | | | | |
|---|---|---|---|---|
| 2,997,907 A | | 8/1961 | Constantino | |
| 3,216,299 A | | 11/1965 | Stoeckli | |
| 3,405,582 A | | 10/1968 | Eichenberger | |
| 3,532,016 A | | 10/1970 | Lane | |
| 3,771,401 A | | 11/1973 | Jasinski | |
| 3,809,220 A | * | 5/1974 | Arcudi | 206/528 |
| 3,809,221 A | | 5/1974 | Compere | |
| 3,899,080 A | | 8/1975 | Brunda | |
| 3,912,081 A | | 10/1975 | Haines et al. | |
| 3,921,805 A | | 11/1975 | Compere | |
| 3,924,746 A | | 12/1975 | Haines | |
| 3,941,258 A | | 3/1976 | Moses et al. | |
| 4,086,837 A | | 5/1978 | Dyck | |
| RE29,705 E | | 7/1978 | Compere | |
| 4,130,040 A | | 12/1978 | Donnelly, Sr. et al. | |
| 4,169,531 A | | 10/1979 | Wood | |
| 4,196,809 A | * | 4/1980 | Tonrey | 206/534 |
| 4,243,144 A | | 1/1981 | Margulies | |
| 4,371,080 A | | 2/1983 | Haines | |
| 4,552,050 A | | 11/1985 | Grefe | |
| 4,553,670 A | | 11/1985 | Collens | |
| 4,673,086 A | * | 6/1987 | Braverman et al. | 206/534 |
| 4,947,718 A | | 8/1990 | Whistler | |
| 5,014,851 A | | 5/1991 | Wick | |
| 5,025,691 A | | 6/1991 | Deni | |
| 5,339,080 A | | 8/1994 | Price | |
| 5,393,032 A | | 2/1995 | Cederroth | |
| 5,469,968 A | | 11/1995 | Matthews et al. | |
| 5,472,093 A | | 12/1995 | Nugent et al. | |
| 5,511,665 A | | 4/1996 | Dressel et al. | |

FOREIGN PATENT DOCUMENTS

| | | |
|---|---|---|
| DE | 3607012 A1 | 9/1987 |
| DE | 3905851 A1 | 7/1989 |
| EP | 0162378 A1 | 11/1985 |
| FR | 2227190 | 4/1974 |

* cited by examiner

*Primary Examiner*—Luan K. Bui

(57) ABSTRACT

A non-through score line is made in the exposed surface of the blister sheet of a blister package. The non-through score line extends from one edge of an individual blister unit to an opposite or adjacent edge, i.e., across the corner of the blister unit. When the blister unit is angulated or flexed back at the non-through score line, the blister sheet will fracture. The smaller portion of the fractured blister sheet, still bonded to a backing sheet, acts as a tab for peeling the backing sheet from the blister sheet exposing the blister contents. Camouflage lines on the blister sheet help hide the score line, thereby rendering the package highly child-resistant.

11 Claims, 6 Drawing Sheets

BLISTER PILL PACKAGE WITH SAFETY BACKING

RELATED APPLICATIONS

This application is a continuation-in-part of U.S. Ser. No. 09/146,567, filed Sep. 3, 1998, now abandoned, which is a continuation-in-part of U.S. Ser. No. 08/807,003, filed Feb. 26, 1997, now abandoned which is a continuation of U.S. Ser. No. 08/550,901, filed Oct. 31, 1995, now abandoned and U.S. Ser. No. 08/770,022 filed Dec. 19, 1996, now U.S. Pat. No. 5,740,717.

BACKGROUND OF THE INVENTION

The present invention relates to a safety blister package for enclosing medication or pills.

As disclosed in U.S. Pat. No. 3,809,211, one of the problems facing today's parents is keeping medication or pills beyond the reach of their children. Children do not have the ability to recognize the risk involved in consuming non-prescription medication. Because of this fact there is an urgent need for a package from which pills are readily accessible to the adult, but not accessible to the child.

Press-through packs or "blister" packs are commonly used today to package units of medication or pills for oral ingestion. The press-through package is made up of a blister sheet, typically a clear, preformed polyvinyl chloride or polystyrene with flexible bubbles which form separate compartments or blisters for one or more pills; and a second rupturable backing sheet, like an aluminum foil or paper sheet, which has been attached to the blister sheet. The metal foil is attached by heat-sealing, solvent welding, gluing, or otherwise adhering the foil sheet to the blister sheet. A tablet is removed from a blister by pressing on the flexible blister which in turn forces the tablet against the foil, rupturing the foil, and ejecting the tablet.

It is sometimes desirable in making such a press-through package to include between the blister and backing sheets a rigid tray in which there are holes which coincide with the blisters in said blister sheet. The rigid tray is used to protect the pills from contamination and mechanical damage and may contain printed instructions as to the type of pill or the time a particular dosage is to be taken and with an indication of the dosage that has already been taken.

The recent trend in the packaging of medication has been to provide packages which will be safe, even if found by children. Most developments in the "child-resistant" line have been directed to the improvement in pill bottles. In this regard, safety caps have been devised which require a certain series of pushes and turns in order to open the bottle. However, there has been little development in the area of "child-resistant" press-type blister packages with which this invention is concerned.

Packages which have used more than one backing sheet on a press-through blister-type package have not used a layer of backing material which cannot be ruptured. The prior layers which have been used to cover the rupturable layer, have been made from paper or foil and may have been scored or weakened so that all backing layers can be ruptured to press a pill through the package. These additional prior art backing layers have been used for the purposes of providing printed information on the back of the pill package and for additional sealing engagement to protect the pills from the environment. For example, see the following U.S. Pat. Nos.: Nagy, U.S. Pat. No. 3,503,493; Osborn, U.S. Pat. No. 3,621,992; Sorensen, U.S. Pat. No. 2,317,860; and Heller, U.S. Pat. No. 3,387,699. In each of these patents the multiple backing layers used on the blister or press-through type pill package can be easily ruptured or peeled away and are not strong enough to provide "child-resistance."

One attempt at providing a "resistant" blister-type pill package, can be seen in the Helstrom U.S. Pat. No. 3,472,368. In this patent, there is no second backing member which is peeled away to expose the rupturable layer as will be disclosed in describing the present invention. This package is supposedly "child-resistant" simply by providing a rupturable sheet which is ruptured with difficulty. The Helstrom patent, therefore, relies on the child's weakness as the necessary element to prevent him from opening the package.

Compere, U.S. Pat. No. 3,921,805, discloses a pill package which requires knowledge of the package opening procedure rather than a minimum amount of strength for opening said package. A person likely to be taking pills is not generally very strong. Quite often, the strength of a child is greater than the strength of an adult who is ill. Because of this fact, this invention was developed to provide a pill package which can be opened by an instructed adult who may have no more strength than the average child. The child who is uninstructed on the opening of the disclosed package will not be able to reach the package contents. The present invention, therefore, relies on the superior knowledge of the adult rather than his superior strength.

SUMMARY OF THE INVENTION

A primary object of the present invention is to provide a "child-resistant" pill package which can be easily opened by one who has been given instructions on how to do so, but cannot be opened by the uninstructed child.

Another object of the present invention is to provide a pill package which, when opened, makes only one dosage of pills accessible to the user, which dosage, of course, is less than a harmful dosage.

Another object of the present invention is to provide a pill package in which any desired number of pills can be made accessible upon opening.

Another object of the present invention is to provide a pill package in which one pill or one dosage of pills can be removed from the package while the remaining pills can be maintained in an air-tight enclosure.

Another object of the present invention is to provide a pill package in which the use of-cumbersome bottles is not required.

Another object of the present invention is to provide a pill package in which each individual pill can be separately packaged so that the desired dosage can be carried by the user without the necessity of carrying excess pills.

Another object of the present invention is to provide a pill package which requires an additional opening step to remove each additional pill.

Another object of the present invention is to provide a safety pill package which children, on average, cannot open without the aid of tools.

Yet another object of the present invention is to provide a pill package in which opening of the package makes accessible fewer than a dangerous number of units of medication. The number of units exposed upon each opening of the package can be varied depending upon the toxicity of the packaged medication.

The present invention provides a blister package which is similar to the common blister package, but which has a strong flexible backing sheet which encloses each blister. The strong flexible backing sheet is secured to the back of the blister sheet in such a manner that when secured, the backing sheet is not pushed away from the blister sheet when pressure is put on the blister-side of the package in an attempt to push the pill through the package. For a user to be able to remove a pill from the package, the strong backing sheet must first be peeled away. So long as the required adherence is obtained, the strong backing sheet can be secured to the blister sheet by heat sealing, solvent welding, gluing or otherwise adhering the two sheets together. A preferred method is by heat-sealing.

There are hundreds of heat-sealed coating formulations which can be used to provide heat-sealability between the layers of the package laminate of the present invention. These heat-seal formulations are commonly used in making foil/paper and resin sheet/resin sheet laminates for soap wraps, carton overwraps, cereal liners, cookie wraps, and other uses. The heat-seal formulations are typically a water dispersion of a vinyl resin or a vinyl resin containing wax for providing lower heat-sealing temperatures. The vinyl resin can be ion-linked and acid-modified ethylene interpolymers known as ionomer resins. Wax and other modifiers further extend the range of performance properties.

The preferred heat-seal formulations are water dispersions of ethylene interpolymers, for example ethylene/vinyl acetate interpolymers. The vinyl resin formulations combine broad adhesion properties with moderate hot tack. Modifiers such as pigments, waxes or other resins can be used.

It is preferred to apply the heat-seal coatings in an amount of about 7 grams/meter$^2$. The coatings can be applied by common methods, for example, curtain coating or roller coatings as known in the art.

The blister sheet is made in a known manner and is made from common blister sheet material such as polyvinyl chloride, and copolymers and terpolymers of vinyl chloride, for example the terpolymer of polyvinyl chloride/polyethylene/polypropylene.

The backing sheet should have a layer or sheet of a strong flexible polymeric material of sufficient strength that a pill cannot be hand-forced through the polymeric material. A sheet of polyester material has been found to have sufficient strength to prevent a pill from being forced therethrough. A preferred polyester material is polyethylene terephthalate.

A foil sheet can also be used as part of the backing sheet if a barrier resistance coating is needed to prevent moisture from penetrating into the blister. A metal foil, such as aluminum, having a thickness as small as 0.0008 inch is sufficient.

A sheet of paper for the purpose of printing may also form part of the backing sheet. Bleached kraft paper having a basis weight of roughly 30 pounds is preferred. Dates, numbers, or a description of the package contents can be printed on the paper for consumer information.

The various layers comprising the backing sheet can be laminated to form a single laminated sheet prior to applying the backing sheet to the blister sheet, or the backing layers can be secured together at the same time they are adhered to the blister sheet. The preferred method of laminating is by using heat-seal coatings, as previously described. It is usually desirable to provide a paper sheet as the sheet farthest from the blister sheet so that printing is easily read from the bottom or non-blister side of the package. However, if it is not necessary to prevent moisture penetration into the blister, the printed paper can be positioned next to the transparent blister sheet and read through the blister sheet from the top of the package.

The strong polymeric sheet, foil sheet, and paper can be applied to the blister sheet in any order except that the paper sheet cannot be positioned next to the blister sheet if it is necessary to prevent moisture from entering the blister. Thus, the strong polymeric sheet can be positioned next to the blister sheet or intermediate between the foil and paper sheet, or as the sheet farthest from the blister. If the paper sheet is between the foil and strong polymeric sheet, the polymeric sheet is preferably transparent so that printing on the paper can be read by the consumer.

When applied as a single lamination structure, the layers of the backing sheet can be secured together by heat-sealing, solvent welding, gluing, applying sheets of adhesive materials between the layers, or otherwise adhering the layers together. For example, a sheet of extruded polyethylene can be included between the sheet of strong flexible material and the foil sheet and likewise between the foil and paper sheet. The extruded polyethylene will adhere the three sheets together upon the application of pressure without the necessity of heat-sealing. It is preferred to use an extruded polyethylene sheet or film. Heat-seal coatings can be used in addition to intermediate adhesive layers.

After securing the blister sheet to the backing sheet, the backing sheet cannot be forced to disengage the blister sheet by applying pressure on the pill from the blister-side of the packet. However, the backing sheet can readily be peeled from the back of the package so that the blister contents can be removed. The seal between the blister sheet and backing sheet must be strong enough so that when pressure is applied to the blister, the flexible backing sheet remains in contact with the blister sheet. The backing must be strong enough so that with the backing sheet engaged, a pill cannot be forced through the backing sheet by applying pressure to the pill from the blister-side of said package.

A strong polyester which has been found particularly effective as at least one component of the backing sheet is polyethylene terephthalate. The thickness of the polyester is preferably about 48 gauge. This gauge also helps prevent biting of the package. However, any plastic with strength sufficient to prevent a pill from being hand-forced therethrough can be used for this purpose.

At least one "non-through" score line is made in the exposed surface of the blister sheet. The score line extends from one edge of an individual blister unit to an opposite or adjacent edge, that is across the corner of the blister unit. The score line penetrates the blister sheet only partially. It does not extend completely through the thickness of the blister sheet. When the blister unit is angulated or flexed at the score line, the blister sheet fractures. The smaller portion of the fractured blister sheet, still bonded to the backing sheet, acts as a tab for peeling the backing sheet from the blister sheet, exposing the blister contents.

The depth of the score line into the blister sheet is critical for producing an effective package. A non-through score line of minimal depth will produce a more effective child resistant package than one with a deeper cut and a non-through score line of maximum depth will produce a more effective senior adult use package than one having a lesser depth. An effective score depth is required to produce a package that is both child resistant and senior effective for a given product toxicity level.

The depth of a score line in a blister package has previously been of no great consequence. However, it has recently been shown that the depth of a score line will significantly enhance the ability of the blister package to pass child resistance (C.R.) tests, as well as senior effectiveness (S.E.) tests. Child resistance tests gauge the ability of a child to successfully open a package within a prescribed time, prior and after having been shown by an adult the proper manner to open the package. Senior effectiveness tests help determine whether typical seniors can successfully open the package.

It has been shown through C.R. testing that as the depth of the score line increases, the blister package becomes senior effective and as it decreases, the blister package becomes more child resistant. A score line depth can be established that creates the optimal C.R./S.E. blister package. Cut depth settings differing by as little as 0.001 inches have shown clear effects in the C.R. test data. Thus, new relevance has been placed on the depth of the score line in the blister package.

The standards for C.R. and S.E. tests vary, but generally they are evaluated according to the following criteria. For a test package to pass a C.R. test, a group of 200 children aged 3½ to 4 are shown how to open the package. Then, these children are asked to open the package individually. If 80% of the children cannot open the package, it is considered to pass the test. On the other hand, if 90% of the seniors (age 65–70) are able to open the device (in other words, the physical qualities of the device are such that 90% of the seniors are able to open the package even though most children cannot), then it is considered to pass the S.E. test.

In another embodiment of the present invention, a surface pattern or camouflage pattern is created on the blister sheet which further obscures the score line needed to open the package. In a preferred embodiment of the invention the camouflage pattern contains elements arranged in the same direction as the score line. In this manner, the score line and the camouflage pattern visually form a consistent appearance in the blister package, further enhancing the child resistant nature of the blister package.

DESCRIPTION OF THE DRAWINGS

The invention together with the above and other objects may be best understood from a consideration of the following detailed description of an illustrative embodiment in the course of which reference is had to the accompanying drawings in which.

DETAILED DESCRIPTION OF THE INVENTION

Figure 1:
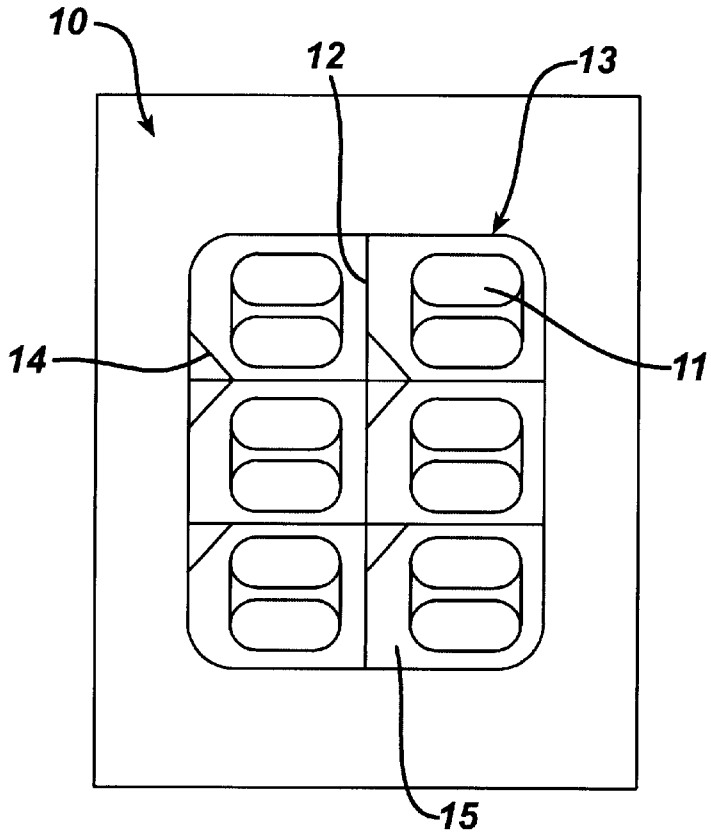
FIG. 1 is a plan view of the safety blister package (card) of the present invention showing multiple individual blister units in one package.
Figure 1A:
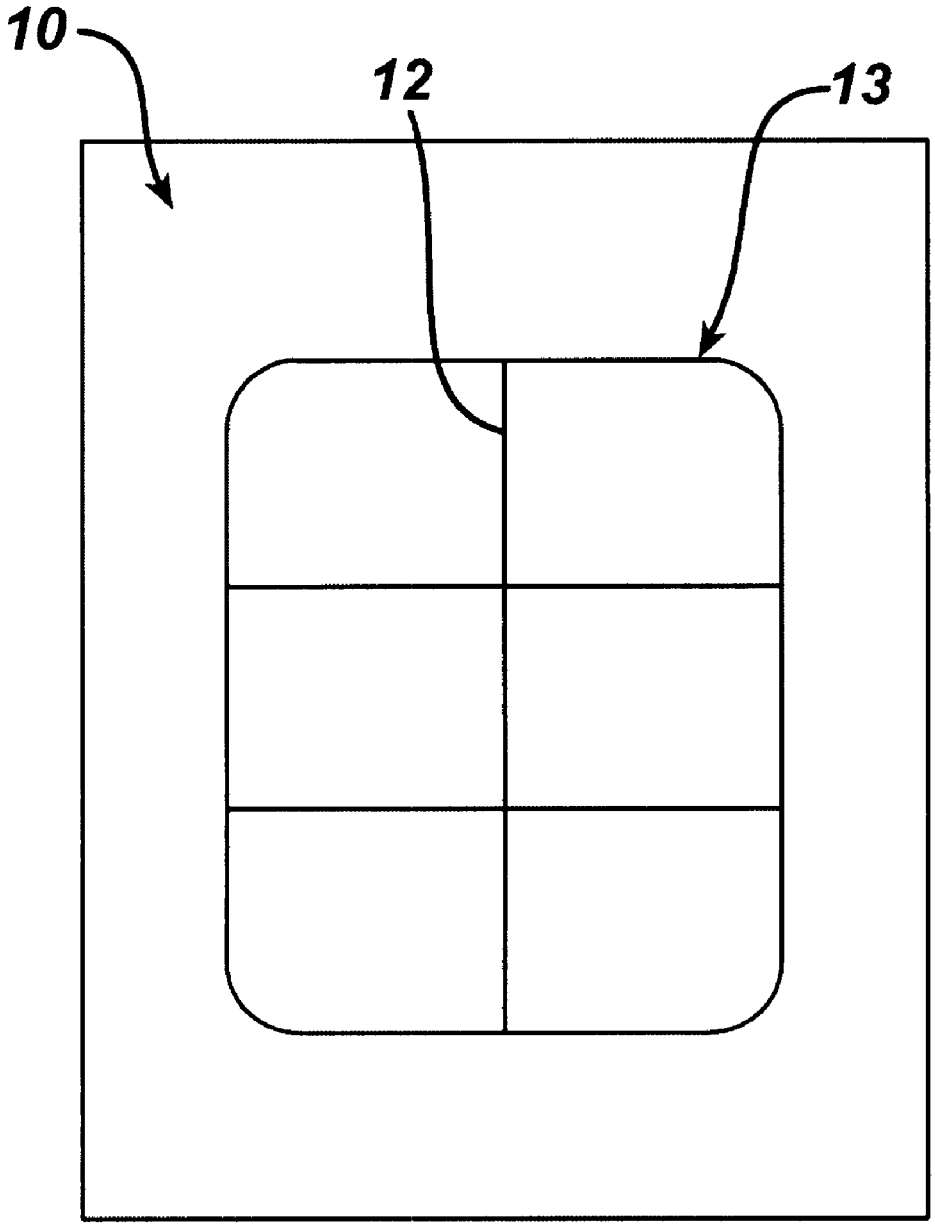
FIG. 1A is a plan view of the rear side of the safety blister package of present invention.

Referring to the drawings and first to FIG. 1, a safety blister package is indicated as a whole by the reference character 10. The package 10 may contain multiple individual blister units 13 having only one single or double cavity 11 of any desired shape which conform to the shape of the particular medicament or pill contained within said blister. The individual blister units 13 can be separated from each other by tearing the package at the perforated cut lines 12, which perforated cut lines are provided through all layers of the blister package. Across one corner of each individual blister unit 13, a score line 14 is cut into the blister sheet 15 providing an opening feature for each individual blister unit 13. When the corner of an individual blister unit 13 is angulated or flexed along the score line 14, the blister sheet 15 is broken along that score cut line 14. FIG. 1A depicts the back of the safety blister package 10, wherein the perforated cut lines 12 are visible in the package providing the individual blister units 13.

The depth of the score line in the blister sheet is an important feature of the present invention. If the depth is too shallow, the score line will be difficult for consumers, and particularly seniors, to observe and therefore open the package. If the score line is too deep it may be apparent to children, who may then be able to open the packages and gain access to the medication. Accordingly, the score line typically penetrates to a depth of about 0.0002 to about 0.015 inches, preferably from about to about 0.001 to 0.010 inches, and most preferably from about to about 0.003 to 0.005 inches into the blister sheet, which typically has a total thickness of about 0.006 to about 0.020 inches, preferably about 0.010 to 0.015 inches. Typically, at least 0.001 inch of the thickness of the blister sheet remains unperforated after the cut of the-score line. Preferably, at least 0.003 inch of the thickness of the blister sheet remains unperforated after the cut of the score line.

Figure 2:
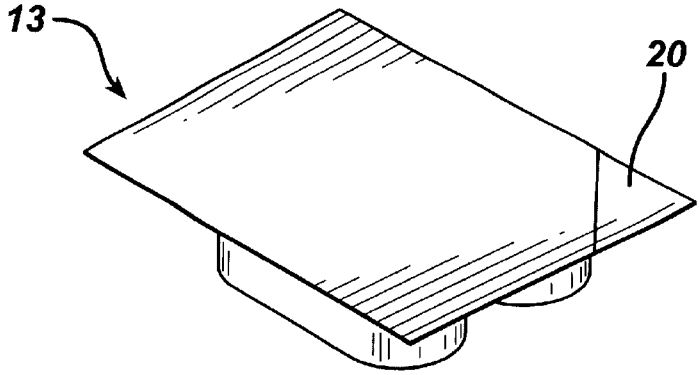
FIG. 2 is a perspective view of one of the individual blister units shown in FIG. 1.
Figure 3:
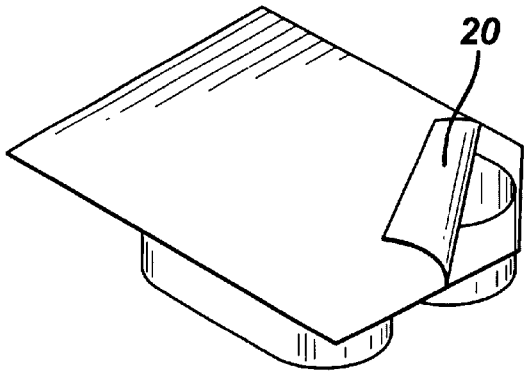
FIG. 3 is a perspective view of one of the individual blister units of FIG. 1 in which the blister unit is partially opened.
Figure 4:
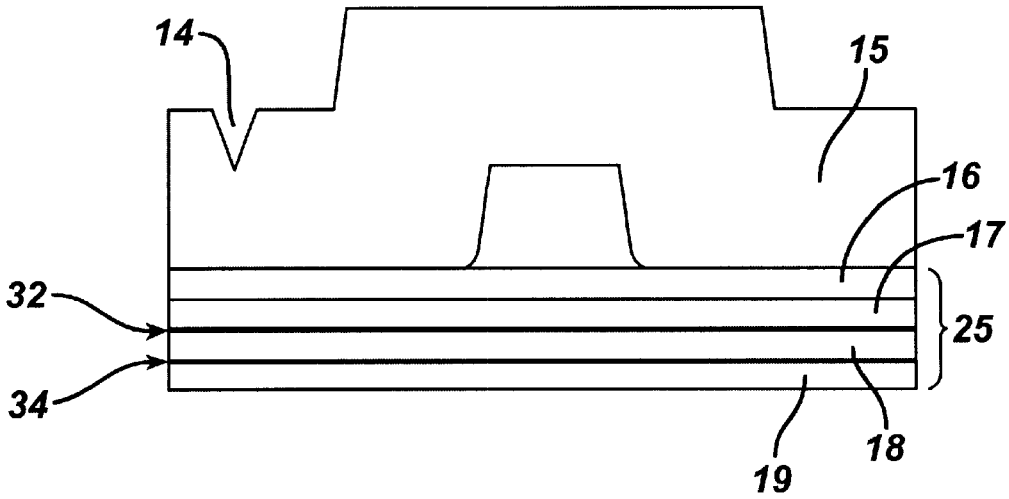
FIG. 4 is an enlarged fragmentary cross section illustrating the various layers, adhesives, and unsealed

Backing sheet 25 as shown in FIG. 4 contains a heat seal coating 16, a foil barrier sheet 17, a sheet of a strong flexible polymeric material for example a polyester such as polyethylene terephthalate 18, and a paper sheet 19 which can have printing thereon to convey information to the consumer such as the package contents and package opening instructions. FIG. 2 and FIG. 3 show tab 20 which is formed by angulating or flexing the corner of an individual blister unit along the score line 14 as explained above.

As previously set forth, the backing sheet 25 need not contain all three layers of foil, strong flexible polymeric material and paper. However, the strong polymeric material is necessary for the purpose of providing a safety backing to the blister sheet 15 so that the pills cannot be forced out of the package without first peeling the backing sheet 25 from the blister sheet 15.

The heat seal coating 16 is typically extruded onto the foil layer 17. FIG. 4 shows one embodiment of adhering the foil, strong flexible polymeric material, and paper layer (i.e. backing sheet 25) to the blister sheet 15. This heat seal coating layer 16 is heated and with pressure applied, bonds to the blister sheet 15. The layers 17, 18, and 19 of the backing sheet 25 can be secured together by heat sealing, solvent welding, gluing, applying sheets of adhesive materials between the layers, or otherwise adhering the layers together. FIG. 4 shows one embodiment of adhering the foil, strong flexible polymeric material, and paper layers together by means of adhesive layers 32 and 34.

Figure 5:
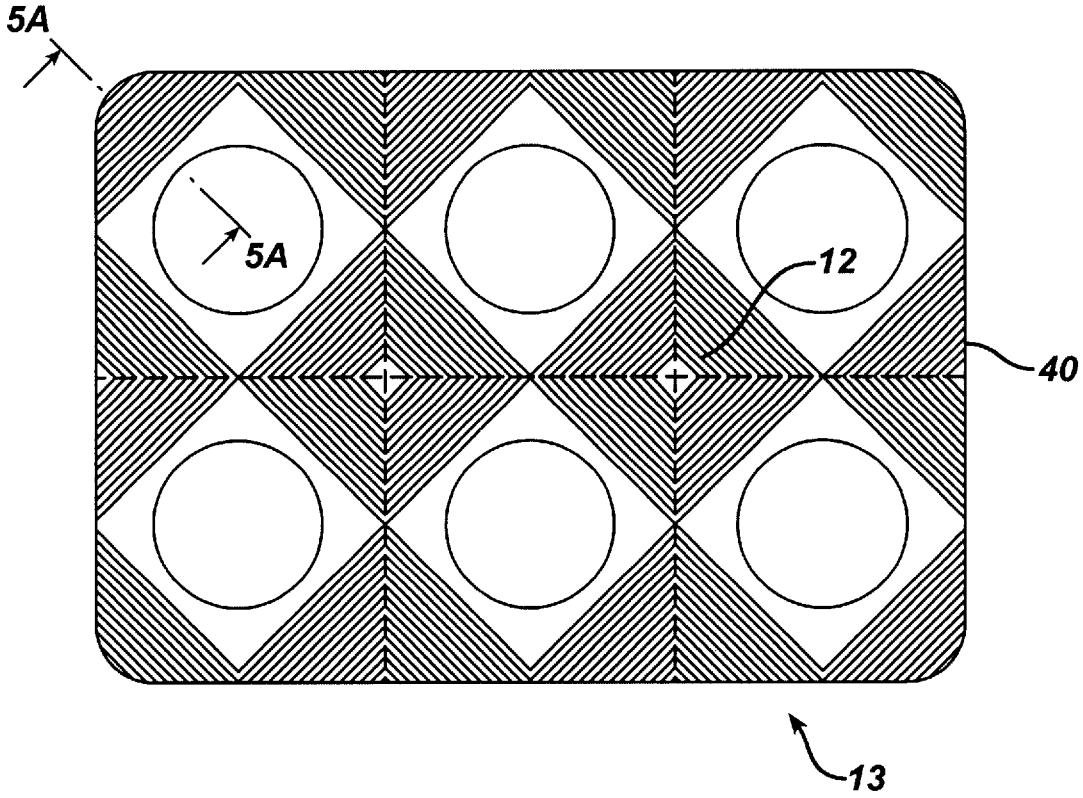
FIG. 5 is a plan view of the safety blister package of the present invention with camouflage ridges depicting a pattern around the medicament.
Figure 5A:
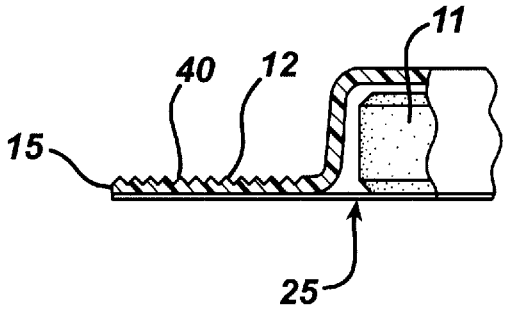
FIG. 5A is a cross-sectional view of the blister package taken along line I—I of FIG. 5.

FIG. 5 depicts the blister pill package 13. A cross-sectional view taken along the line I—I is depicted in FIG. 5A. As is apparent from FIG. 5 the ridges 40 in the blister sheet provide camouflage for, or hide the actual score lines 12. When the entire blister package is viewed from the top it is not apparent where or how the medicaments are to be accessed. An adult desiring to open the package would learn how to do so by reading the directions provided on the perhaps on an insert, or on the cover of the box which contains the blister pill package, or on the back side of the blister pill package.

Figure 6:
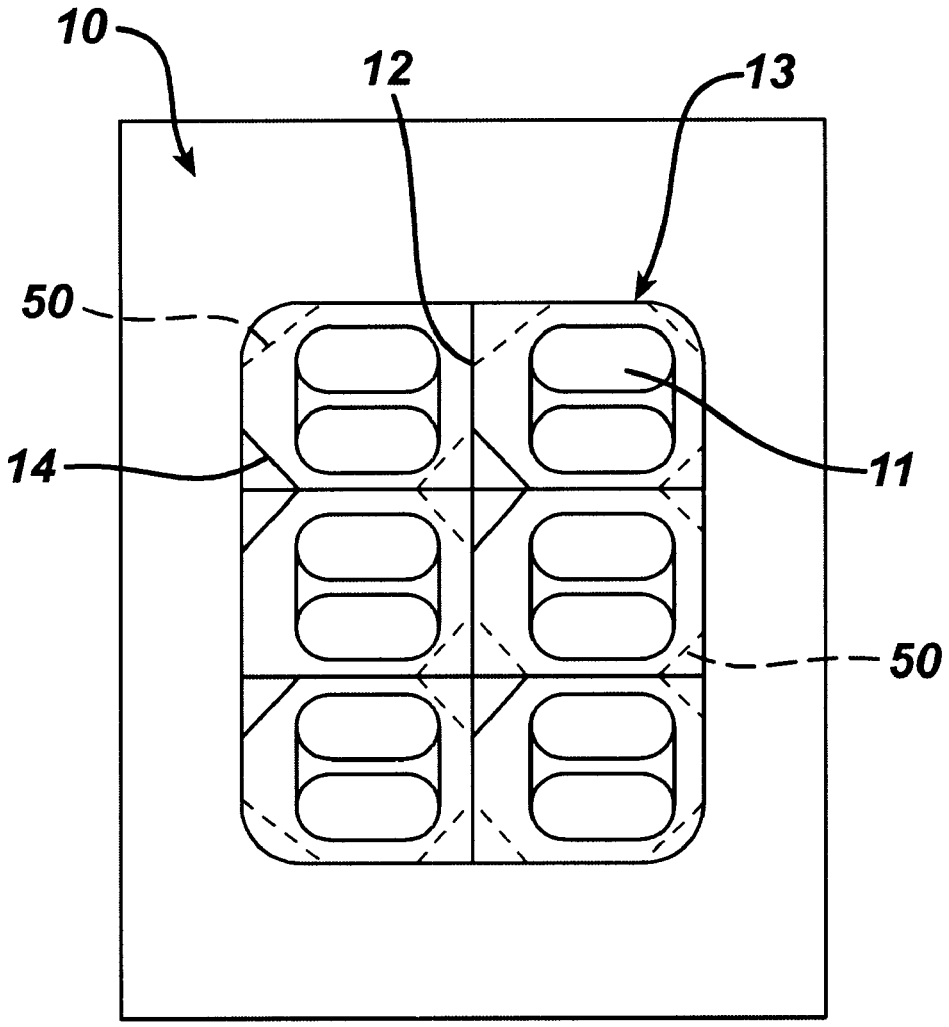
FIG. 6 is a plan view of the safety blister package of the present invention depicting a non-through score cut line and three simulated score lines in the other corners of the blister package.
Figure 7:
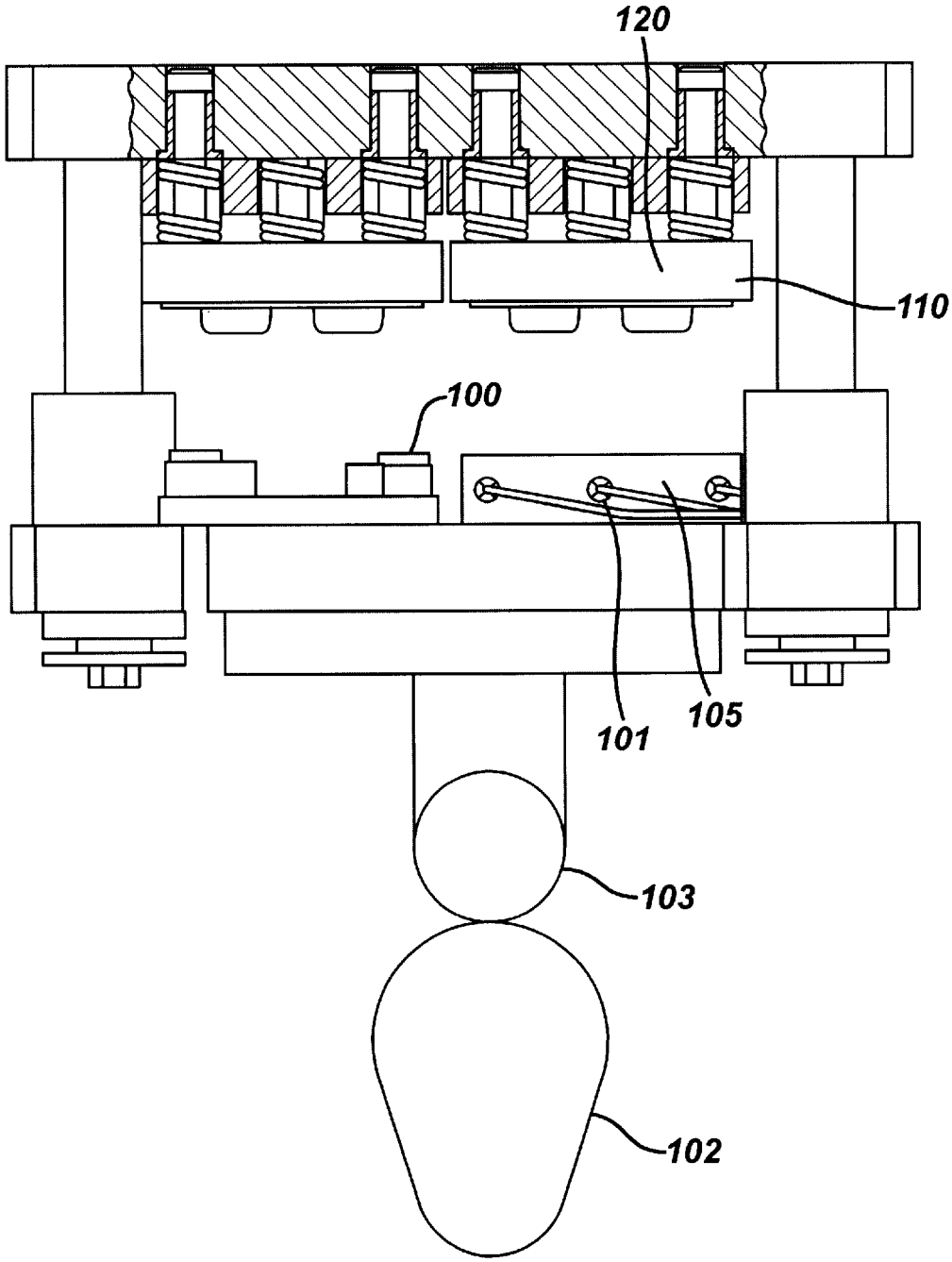
FIG. 7 is a cross-sectional view of a tooling machine that may be used for manufacturing the camouflage ridges of the present invention.

FIG. 6 provides an alternative embodiment of the present invention wherein the score lines 14 are supplemented by "simulated" score lines 50. These simulated score lines can be located in the various corners of the individual blister units. One or more of these simulated score lines can be provided. In a preferred embodiment, three simulated score lines are provided in the corners of an individual blister unit 13 thereby providing only a 1 in 4 chance of a child selecting the correct corner without reading the opening instructions. Those with skill in the art will appreciate in addition to the simulated score lines, various patterns of camouflage ridges can be provided without departing from the scope of the invention. In addition, a cross-hatch pattern can also be placed on the metal foil sheet to act as camouflage lines to help in hiding the score line.

The camouflage lines are provided in the blister sheet by any suitable means, such as chemical etching, laser etching, or by mechanical means such as knives, heating elements, stamping or the like. Preferably the camouflage lines are stamped into the blister sheet either through the backing material, or on the outer surface of the blister sheet. Use of a heat stamp, rather than knives as the means to provide the camouflage lines enables the cavities formed to have a rounded, rather than a sharp bottom. The rounded-bottom camouflage lines may be stamped to a greater depth within the film without causing crack propagation and breakage of the film. The depth of the preferred rounded-bottom camouflage lines may thus be greater than the depth of the score lines, equal to the depth of the score lines, or less than the depth of the score lines. Typically the camouflage lines penetrate the blister sheet from about 0.0001 inch to about 0.015 inch, preferably from about 0.0003 inch to about 0.009 inch, and most preferably from about 0.0005 to about 0.005 inch.

U.S. Pat. No. 5,740,717, hereby incorporated by reference as set forth in its entirety, employs knives to cut lines in the blister sheet. The score blade is shown as well as the ridge block. Cartridge heaters are provided within the interior of the ridge block. The cartridge heaters can be powered by any suitable means including electric means. The blisters are formed by the stamping of the blister form onto the base. The ridge block can impart camouflage lines to the blister sheet.

While the present invention has been described with reference to a medicament or pill, it can also be used to make a child-resistant package for capsules, tablets, suppositories, etc.

It is believed that there are significant differences making this concept more cognitive, more child resistant, and potentially easier to open for the senior adults then, for instance Compere '805. Those differences include:

1. Child Resistant: Children tend to focus their attention on areas of difference (i.e. protrusions, unsealed areas) on the cavity or "pill" side of the blister unit. If there are no areas of difference, children will randomly pick at and bend the blister unit.

a. With the present invention, there are no apparent areas of difference:
   i. there are no protrusions
   ii. there are no accessible unsealed areas
   iii. the score cut line is nearly invisible to the child, partially due to being "camouflaged" by a cross hatch pattern by the seal.

b. the opening feature is robust for random aggressive handling
   i. the score line depth is minimized
   ii. the score line is optimally positioned (corner cut)

2. Ease of Opening: Senior adults will not have to rely on physical force to open package a. the bending and breaking of the blister sheet will require minimal force (dependent on child access)

b. the peel strength of the backing sheet will be minimal. If the bending task is not apparent to children, the seal strength of the backing sheet to the forming material can be reduced.

3. Cognitive: Senior adults will have to rely on cognitive skills rather than physical force to open this package. If the multiple step opening instructions are well communicated, the seniors will be able to access the contents of the package effectively where as the children will not.

What is claimed is:

1. A protective childproof package comprising:

a blister sheet comprising one or more flexible blister units comprising blisters, each blister being adapted to receive a medicament, said blister sheet further comprising at least one score line extending along a corner of a blister unit and having a first depth that does not completely penetrate through the thickness of said blister sheet;

a plurality of camouflage lines in said blister sheet having a second depth;

a backing sheet secured to the blister sheet along the edges of the blister sheet and over substantially the entire backing sheet surface area except at each blister, such that said backing sheet cannot be forced out of engagement with said blister sheet when force is applied to said blisters, thereby sealing the blisters; and said backing sheet comprising at least one sheet of material having sufficient strength to prevent the backing sheet from rupturing or being forced out of engagement with the blister sheet when force is applied to the medicament from the blister side of the package;

wherein the first depth is such that at least about 80% of children aged 3.5 to 4 years cannot open the package and greater than about 90% of adults aged 65–70 are able to open the package.

2. A protective childproof package as defined by claim 1, wherein the second depth is different than the first depth.

3. A protective childproof package as defined by claim 1, wherein the camouflage lines have a rounded shape, which is different from the shape of the score lines.

4. A protective childproof package as defined by claim 2, wherein the first depth is from about 0.0002 to about 0.015 inch, and the second depth is from about 0.0001 to about 0.015 inch.

5. A protective childproof package as defined by claim 1 wherein the blister sheet is secured to the backing sheet with a heat seal coating.

6. A protective childproof package of claim 1 wherein the backing sheet contains a polymeric material.

7. A protective childproof package of claim 6 wherein the polymeric material is a polyester.

8. A protective childproof package of claim 7 wherein the polyester is polyethylene terephthalate.

9. A protective childproof package of claim 1 wherein the backing sheet contains a metal foil.

10. A protective childproof package of claim 9 wherein the metal foil is aluminum.

11. A protective childproof package of claim 1 wherein at least 0.001 inch of the thickness of the blister sheet remains unperforated beneath the score line.

* * * * *